US005547302A

United States Patent [19]

Dornbusch et al.

[11] Patent Number: 5,547,302

[45] Date of Patent: Aug. 20, 1996

[54] TWIST-UP PRODUCT DISPENSER HAVING CONFORMABLE APERTURED APPLICATOR SURFACE

[75] Inventors: Arthur H. Dornbusch; Scott E. Smith, both of Cincinnati, Ohio

[73] Assignee: The Procter & Gamble Company, Cincinnati, Ohio

[21] Appl. No.: 282,676

[22] Filed: Jul. 29, 1994

[51] Int. Cl.[6] ..... A45D 40/06; A45D 40/10

[52] U.S. Cl. ..... 401/172; 401/175; 401/180; 401/266; 401/68

[58] Field of Search ..... 401/176, 68, 74, 401/75, 79, 268, 53, 54, 70, 80, 172, 180, 174, 175, 266

[56] References Cited

U.S. PATENT DOCUMENTS

| | | | |
|---|---|---|---|
| 445,701 | 2/1891 | Lee . | |
| 448,197 | 3/1891 | Beutelspacher . | |
| 718,969 | 10/1903 | Altshul | 401/176 |
| 1,235,351 | 7/1917 | McLaughlin . | |
| 1,664,936 | 4/1928 | Lyman . | |
| 2,276,722 | 3/1942 | Hillman | 91/62.5 |
| 2,320,749 | 6/1943 | Pressentin | 221/79 |
| 2,379,105 | 6/1945 | Rosa | 206/56 |
| 2,605,936 | 8/1952 | Gabler | 222/327 |
| 2,738,905 | 3/1956 | Olson | 222/387 |
| 2,780,203 | 2/1957 | Moran et al. | 120/47 |
| 2,789,692 | 4/1957 | Ferri | 206/56 |
| 2,810,146 | 10/1957 | Jarvis | 15/122 |
| 3,195,168 | 7/1965 | Roberts | 15/510 |
| 3,368,806 | 2/1968 | Szonn | 267/1 |
| 3,756,730 | 9/1973 | Spatz | 401/174 |
| 4,013,370 | 3/1977 | Gingras | 401/175 |
| 4,139,127 | 2/1979 | Gentile | 222/390 |
| 4,223,999 | 9/1980 | Wells | 401/266 X |
| 4,595,124 | 6/1986 | Duval et al. | 222/39 |
| 4,668,106 | 5/1987 | Gu | 384/105 |
| 4,753,373 | 6/1988 | Seager | 222/390 |
| 4,850,516 | 7/1989 | Seager | 222/390 |
| 4,865,231 | 9/1989 | Wiercinski | 222/390 |
| 4,884,911 | 12/1989 | Oikawa | 401/65 |
| 4,954,000 | 9/1990 | Gueret | 401/68 |
| 5,000,356 | 3/1991 | Johnson et al. | 222/391 |
| 5,007,755 | 4/1991 | Thompson | 401/175 |
| 5,019,033 | 5/1991 | Geria | 604/2 |
| 5,112,178 | 5/1992 | Overhues et al. | 411/544 |
| 5,207,357 | 5/1993 | Aronie et al. | 222/134 |
| 5,230,577 | 7/1993 | Cox et al. | 401/68 |
| 5,255,990 | 10/1993 | Dornbusch et al. | 401/68 |
| 5,294,205 | 3/1994 | Moeck et al. | 401/70 |

FOREIGN PATENT DOCUMENTS

| | | | |
|---|---|---|---|
| 0312165 | 4/1989 | European Pat. Off. . | |
| 913133 | 8/1946 | France | 401/75 |
| 968384 | 11/1950 | France . | |
| 1261214 | 4/1961 | France . | |
| 1398164 | 3/1965 | France . | |
| 828820 | 7/1949 | Germany | 401/266 |
| 58-9535 | 2/1983 | Japan | 401/75 |
| WO91/04690 | 4/1991 | WIPO . | |

*Primary Examiner*—Steven A. Bratlie

*Attorney, Agent, or Firm*—J. C. Rasser; D. F. Nesbitt; W. S. Andes

[57] ABSTRACT

The present invention relates to improved product dispensers for various products, including solids, gels, semi-solids, and other substantially solid products. In a preferred embodiment of the present invention, the dispenser is in the form of an improved twist-up type dispenser with an application/distribution surface in the form of a mesh applicator head for covering the exposed end of a solid stick of product. The dispenser includes a force-limiting mechanism to limit the force exerted by the product on the mesh applicator head during pre-loading to prevent extrusion of the product. The dispenser further includes a force-maintaining mechanism to maintain the surface of the product in continuous intimate contact with the mesh applicator head during the application process. The surface of the product exposed via the apertures is sheared off in conventional fashion, and the mesh provides for a more even distribution of the product than conventional solid stick-type dispensers. The resulting dispenser provides application and distribution properties superior to current solid-stick dispensers and enables the product to be more easily applied in a consistent, less messy fashion.

18 Claims, 6 Drawing Sheets

TWIST-UP PRODUCT DISPENSER HAVING CONFORMABLE APERTURED APPLICATOR SURFACE

FIELD OF THE INVENTION

The present invention relates to improved product dispensers for various products, including solids, gels, semi-solids, and other substantially solid products. More particularly, the present invention relates to improved twist-up dispensers for applying and distributing products on surfaces in the form of a film or coating.

BACKGROUND OF THE INVENTION

Of the various dispenser types available for dispensing various spreadable products (including solids, gels, semi-solids, and other substantially solid products) and applying them to a surface, one widely used type of dispenser is a twist-up type of applicator. In this type of dispenser, a substantially solid stick of product is placed within a tubular holder having one end open (a dispensing opening) and the other end closed. A rotatable handwheel is provided at the closed end to drive an elevator mechanism for advancing the stick of product toward the dispensing end of the dispenser. The handwheel is rotated so that a desired portion of the solid stick protrudes beyond the dispensing end of the dispenser. When the exposed end of the solid stick is drawn across the desired surface, a layer of product is sheared off of the exposed end of the solid stick and adheres to the desired surface. The thickness of this layer is controlled by a number of factors, including the texture of the desired surface, the viscosity or abrasion-resistance of the product, the width of the solid stick in the direction normal to the application direction, etc. As the exposed end of the solid stick is drawn over the surface, the layer of product is applied to the surface along the contact path of the solid stick.

Current commercially available twist-up dispensers utilize the exposed end of the solid stick to not only apply the product to the desired area, but also to perform the distribution function. If a consumer utilizes the solid stick to further distribute product already applied, additional product continues to be dispensed as the solid stick slides across the surface. This tends to result in uneven, generally excessive applications of product with accompanying waste of the product and consumer negatives such as residue.

Current commercially available dispensers also typically have a comparatively large surface area on the end of the solid stick to provide a better feel (for applications to a human body) and to minimize the number of strokes needed to obtain the desired coverage. Since abrasion of the solid stick against the desired surface is the mechanism for shearing product off of the end surface of the solid stick, variations in the surface texture of the desired surface and the shear resistance of the product tend to result in uneven layers or pieces of product of visible size being sheared off and deposited upon the desired surface. This in turn results in uneven coverage of the desired surface with areas of insufficient product application and areas of excessive product application, as well as the undesirable appearance of pieces of product adhered to the surface.

Accordingly, it would be desirable to provide a product dispenser which is easy to use and provides for a more even, less messy application of the product.

SUMMARY OF THE INVENTION

The present invention provides an improved twist-up type dispenser with an application/distribution surface in the form of a conformable mesh applicator head for covering the exposed end of a solid stick of product.

The mesh applicator head consists of a dome-like piece of a conformable/deformable mesh material provided with a collar for securing it to the body of a twist-up dispenser. The mesh applicator head includes a plurality of discreet apertures for exposing portions of the end of the stick of product. An advance mechanism is provided to advance the solid product within the dispenser toward and against the mesh applicator head. A force-limiting mechanism is provided to prevent the product from being forced against the mesh with excessive levels of force. This in turn prevents extrusion of the product through the mesh (excessive penetration of the mesh into the product surface) or damage to the mesh applicator head itself. The advance mechanism also includes a force-maintaining mechanism to maintain a desired force level of the product against the mesh applicator head during a dispensing operation in order to provide for relatively consistent dispensing and distribution characteristics. The resulting dispenser provides application and distribution properties superior to current solid-stick dispensers and enables the product to be more easily applied in a consistent, less messy fashion. The simplicity of the dispenser construction equates to a very user-friendly package which is cost effective to produce and reliable in operation.

BRIEF DESCRIPTION OF THE DRAWINGS

The present invention will be better understood with reference to the following Detailed Description and to the accompanying Drawing Figures, in which.

Unless otherwise indicated, like elements are identified by like numerals throughout the Drawing Figures.

DETAILED DESCRIPTION OF THE INVENTION

Figure 1:
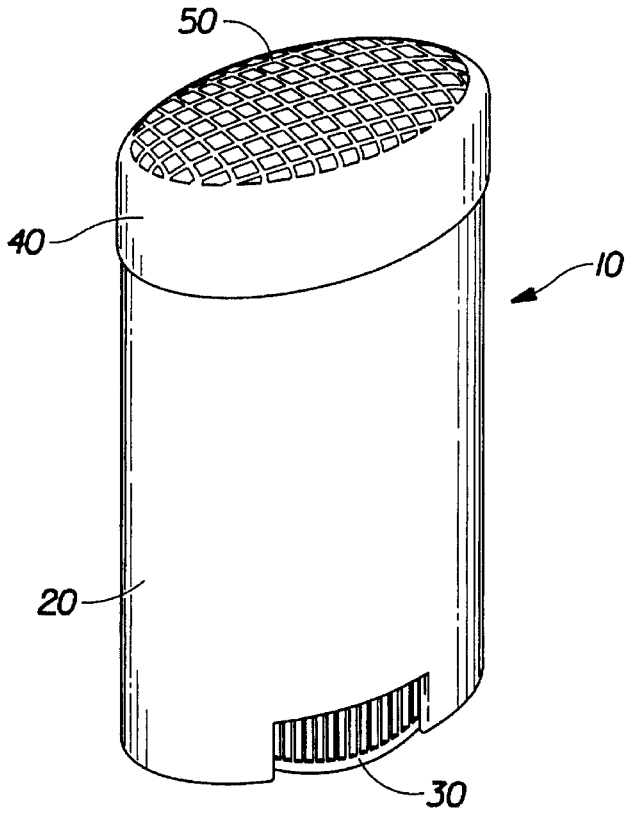
FIG. 1 is a perspective view of one embodiment of an improved dispenser according to the present invention.

FIG. 1 depicts an improved dispenser according to the present invention. As shown in FIG. 1, the dispenser 10 includes a dispenser body 20, a handwheel 30, a collar 40, and a mesh applicator head 50. Although collar 40 could be fabricated as a separate element from the mesh portion of the applicator head 50, collar 40 is preferably formed or molded as an integral part of the applicator head. As shown in FIG. 1, such dispensers have a similar overall appearance to conventional twist-up dispensers with their elongated dispenser body 20 of generally oval cross-section and handwheel 30 projecting outwardly from the elongated sides of the dispenser body.

Figure 2:
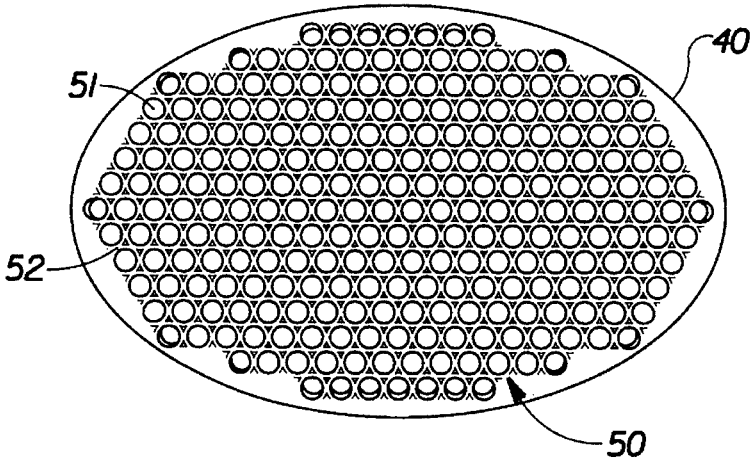
FIG. 2 is an enlarged plan view of the mesh applicator head depicted in FIG. 1.

FIG. 2 depicts in greater detail the geometry of a presently preferred mesh configuration for mesh applicator head 50. As used herein, the term "mesh" is used generically to refer to a comparatively thin, flexible structure having a plurality of discreet openings or apertures extending through its thickness. The mesh may have the characteristics of a fabric screen, or may have a greater structural rigidity and be more grid-like. Accordingly, the mesh applicator head 50 includes a number of discreet openings for product distribution in the form of interstitial spaces 51 which are separated by mesh walls 52. The dimensional and geometrical characteristics of the applicator head 50 are governed by the physical and operational characteristics of the intended product, as will be discussed below. Although in the preferred configuration depicted in FIG. 2 the interstitial spaces are of uniform size, shape, and spacing, these parameters may be readily tailored to suit a particular application in terms of product characteristics and desired distribution pattern.

Figure 3:
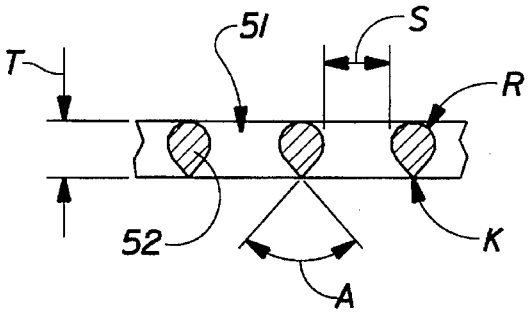
FIG. 3 is an enlarged, elevational sectional view of the mesh structure of the applicator head depicted in FIG. 2.

The key features of the mesh applicator head 50 are depicted in greater detail in FIG. 3. For ease of discussion, the following features will be identified with letters. As shown in FIG. 3, the letter "S" represents the mesh spacing or size of the interstitial spaces 51. Mesh spacing S corresponds to the distance in a given direction between successive mesh walls 52. In the configuration depicted in FIG. 2, the interstitial spaces are substantially circular in shape, and hence mesh spacing S represents the diameter of the interstitial spaces. The letter "R" represents the radius of the upper portion (distribution side) of the mesh walls 52, which are preferably radiused as shown to avoid excessive abrasion of the receiving surface. The letter "K" refers to the "knife" edge of the lower portion (product side) of the mesh walls 52, which is preferably at least somewhat wedge-shaped to facilitate penetration of the mesh walls into the upper surface of the product stick. Angle "A" defines the included angle between adjacent sides of the knife edge K. The letter "T" represents the overall thickness of the mesh material.

The parameters of the mesh portion of the mesh applicator head are tailored to suit a particular product application and receiving surface context. The size of the interstitial spaces "S", the shape of the knife edge defined by "K" and angle "A", and the shape of the interstitial spaces are all tailored so as to prevent product from being extruded through the interstitial spaces during normal use of the dispenser. At the same time, these parameters must also be tailored to permit sufficient exposure of the product surface via interstitial spaces 51 and sufficient contact between the exposed product surface and the receiving surface so as to permit application of the product onto the receiving surface.

The thickness "T" of the mesh, as well as the percentage of open area and size of the spaces, are also tailored so as to control the amount of conformity and flexibility present in the dome itself. Such conformity is necessary not only to enable the dome to conform to various curved and irregular receiving surfaces but also to facilitate the very application of product. It is worthy of note that the mesh used in the present invention, while conformable, must have sufficient stretch-resistance to prevent ballooning or outward deformation of the dome-like application surface when pressure is applied to the underside of the mesh by the advancing product. The mesh material must also be sufficiently inelastic and have sufficient rigidity so as to prevent stretching and/or wrinkling of the mesh material as it is swept across the receiving surface.

It should be noted that while FIG. 2 illustrates a presently preferred mesh configuration with the apertures or interstitial spaces having a substantially-circular cross section, a wide variety of other aperture shapes could be employed. Such other shapes include oblong, rectangular, honeycomb, and square (such as depicted in FIG. 1). Mesh applicator heads may also incorporate diverse shapes, sizes, and spacing of apertures depending upon the particular product and receiving surface of interest, although a relatively uniform size, shape, and spacing are presently preferred.

In contrast to solid stick-type twist-up dispensers, wherein the product itself performs both the application and distribution functions, and twist-up dispensers which extrude a creamy or gel-like product and rely upon a rigid applicator surface to apply and distribute the product, the mesh applicator heads of the present invention effectively disassociate the application and distribution functions. The interstitial spaces of the mesh applicator head allow small, discrete regions of the surface of the product stick to directly contact the receiving surface and to apply product to the surface via a shearing action as with a conventional solid stick. The distribution function, however, is performed by the mesh walls which separate the interstitial spaces. As product is applied to the receiving surface by each individual interstitial space, it is evenly distributed over the surface by the mesh walls surrounding the individual interstitial spaces as the mesh applicator head is swept across the receiving surface.

In order for the application of product to take place, the product must at the initiation of the application process be substantially flush with the upper surface of the mesh walls such that the interstitial spaces are substantially "level full" of product. The product should not, however, be extruded through the spaces so as to project above the upper surface of the mesh walls as this would lead to excessive product application and waste of the product. Put another way, the mesh walls penetrate into the upper surface of the product stick to a distance substantially equal to the thickness "T" of the mesh. This is governed by such factors as the mesh size or spacing "S", the shape of the knife edges "K", the percentage of open area of the mesh, and the penetration value of the product.

As soon as the mesh applicator head begins to sweep across the receiving surface, the product begins to be sheared off and the product surface recedes below the surface of the mesh. The mesh applicator head is preferably sufficiently conformable so as to be deformed inwardly to press the portion of the mesh contacting the receiving surface into the product and aid in maintaining the level of the product in the interstitial spaces. This minor deflection of the mesh material (which may take the form of slight undulations or waves) allows the product within individual apertures or interstitial spaces to contact the receiving surfaces sequentially during application to deposit their supply of product upon the surface, where it is distributed by the surrounding mesh walls.

The product is also preferably maintained in constant intimate contact with the mesh applicator head with a pre-determined level of force or pressure to prevent instantaneous loss of application functionality as soon as product begins to leave the interstitial spaces. This force level is maintained between a maximum level just below that which would extrude product through the mesh and a lower level which presents minimal functionality (and may indeed be zero). This force or pressure may be termed a "pre-load", and is preferably applied via a twist-up type advance mechanism. A force maintaining aspect of the advance mechanism is preferably included to maintain a preloading force on the product and hence contiguous contact between the leading edge of the product and the mesh applicator head during the application process.

The pre-load force and the force-maintaining mechanism are designed to maintain the required level of force for the particular product throughout the intended application process. Once sufficient product within the interstitial spaces is sheared away, and the force-maintaining mechanism has reached the end of its travel, the interstitial spaces will be at least partially empty and present a visual cue to the consumer to actuate the advance mechanism to advance more product into the mesh for the next application.

In order to prevent extrusion of the product during the pre-loading process, with the accompanying negative effects described above, it is desirable that the advance mechanism also include a force limiting mechanism to prevent the consumer from over-advancing the product. This force limiting mechanism preferably interrupts the advance process by preventing further movement of product toward the mesh applicator head once a threshold force value is reached. This threshold force value represents the maximum desirable pre-load force which is determined to be just below the level of force which would begin to extrude product through the interstitial spaces. Preferably, this limiting function prevents further rotation of the twist-up elevator mechanism and presents a noticeable cue to the consumer that the desired pre-loading condition has been achieved and the dispenser is ready for use. The force limiting feature also prevents damage to the mesh applicator head or the advance mechanism caused by excessive internal pressures. The force-limiting mechanism also provides a consistent, repeatable dispensing configuration with an optimum level of force exerted on the mesh.

Figure 4:
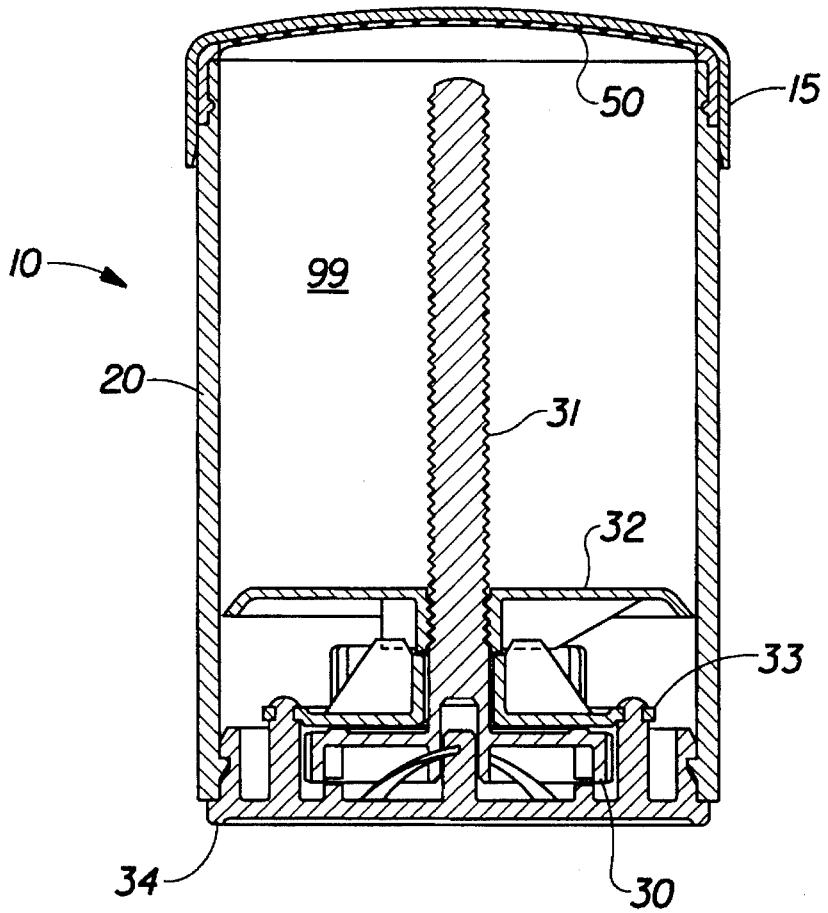
FIG. 4 is an elevational sectional view of the internal components of a dispenser according to the present invention.
Figure 5:
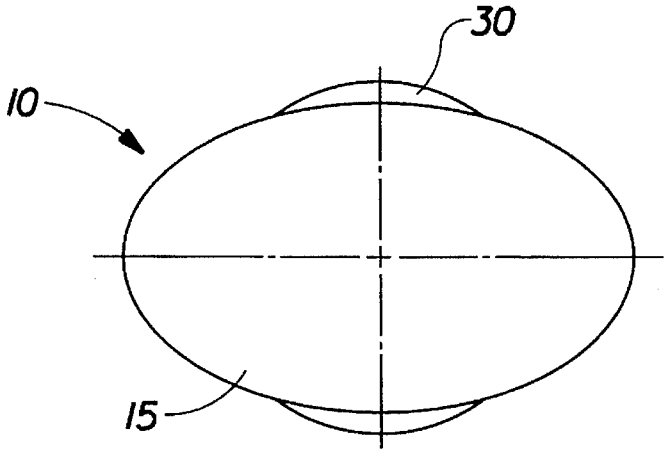
FIG. 5 is a plan view of the dispenser of FIG. 4.

FIG. 4 is an elevational sectional view of one dispenser execution illustrating the product supply mechanism for advancing the product 99 toward the applicator head. The product supply or advance mechanism includes handwheel 30, elevator screw 31, product elevator 32, top plate 33, and bottom plate 34. FIG. 5 is a plan view of the dispenser of FIG. 4, and illustrates the relationship of the handwheel 30 to the profile of the dispenser 10, wherein the handwheel protrudes outwardly from the broader sides of the somewhat oval-shaped dispenser 10 where it may be readily manipulated by a consumer to advance the product. Handwheel 30 is depicted in greater detail in FIGS. 6 and 7, while bottom plate 34 is depicted in greater detail in FIGS. 8 and 9. The dispenser 10 shown in FIG. 4 further illustrates the use of an overcap 15 to enclose mesh applicator head 50 during periods of non-use to preserve unused product within the dispenser.

Figure 6:
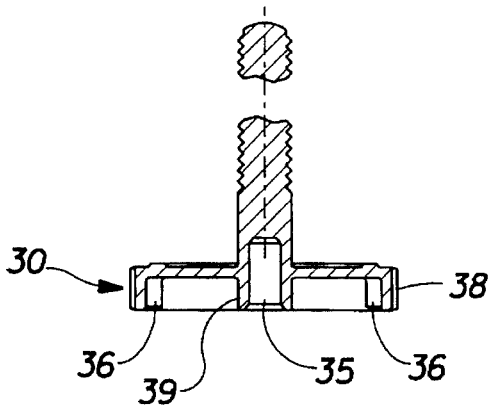
FIG. 6 is an elevational sectional view of the handwheel assembly depicted in FIG. 4.
Figure 7:
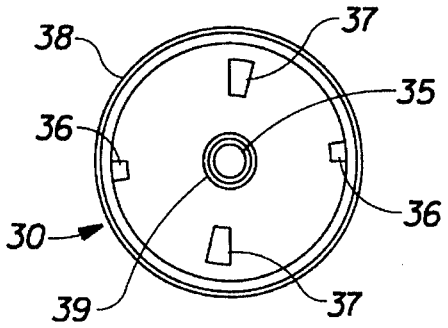
FIG. 7 is a bottom plan view of the handwheel of FIG. 6.

FIGS. 6 and 7 are elevational sectional and bottom plan views, respectively, of the handwheel of FIG. 4, illustrating in greater detail the structural elements which cooperate with the bottom plate 34 to provide the force-limiting and force-maintaining capabilities of this dispenser configuration. As shown in FIGS. 6 and 7, the handwheel 30 includes a central region 39, an outer rim 38, a boss 35, stop lugs 36, and rotational lugs 37.

Figure 8:
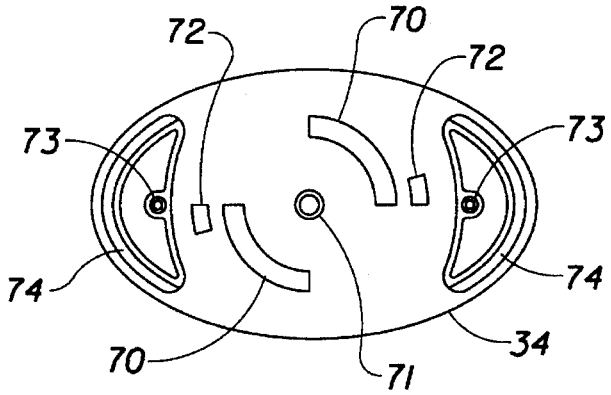
FIG. 8 is a plan view of the bottom plate depicted in FIG. 4.
Figure 9:
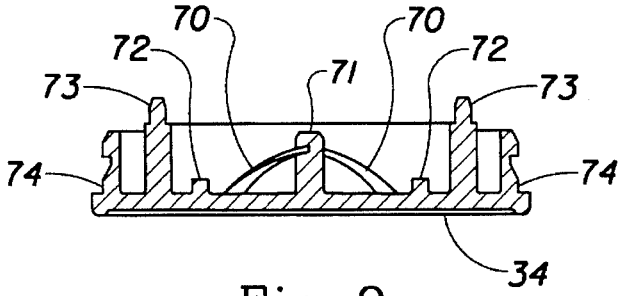
FIG. 9 is an elevational sectional view of the bottom plate of FIG. 8.

FIGS. 8 and 9 are plan and elevational sectional views of the bottom plate 34 of FIG. 4, illustrating again in greater detail the structural elements which cooperate with the handwheel 30 to provide the force-limiting and force-maintaining capabilities of this dispenser configuration. As shown in FIGS. 8 and 9, the bottom plate 34 includes a plurality of spring elements 70, a center post 71, stop posts 72, pins 73 for securing the top plate 33 to the bottom plate 34, and snaps 74 for securing the bottom plate into the container 20. Although two spring elements 70 are shown, any number of spring elements or resilient elements could be utilized to provide spring-like functionality.

In the assembled condition, boss 35 fits over center post 71 to maintain the alignment of the handwheel 30 during operation. As the handwheel 30 is rotated to advance the product 99, resistance encountered as the product contacts the mesh applicator head 50 begins to force the handwheel assembly downward against the spring elements 70. Rotational lugs 37 snap over the free upper ends of the spring elements 70 creating an audible click with each half revolution and also preventing retrograde rotation of the handwheel 30. When the limiting force condition is reached, the handwheel 30 will have compressed spring elements 70 sufficiently that the stop lugs 36 engage the stop posts 72 to prevent further rotation of the handwheel 30 and thus further advancement of the product. The dimensions of stop lugs 36 and stop posts 72, as well as the spring characteristics of spring elements 70, are tailored to achieve the desired force-limiting and force-maintaining characteristics with the product of interest.

Figure 10:
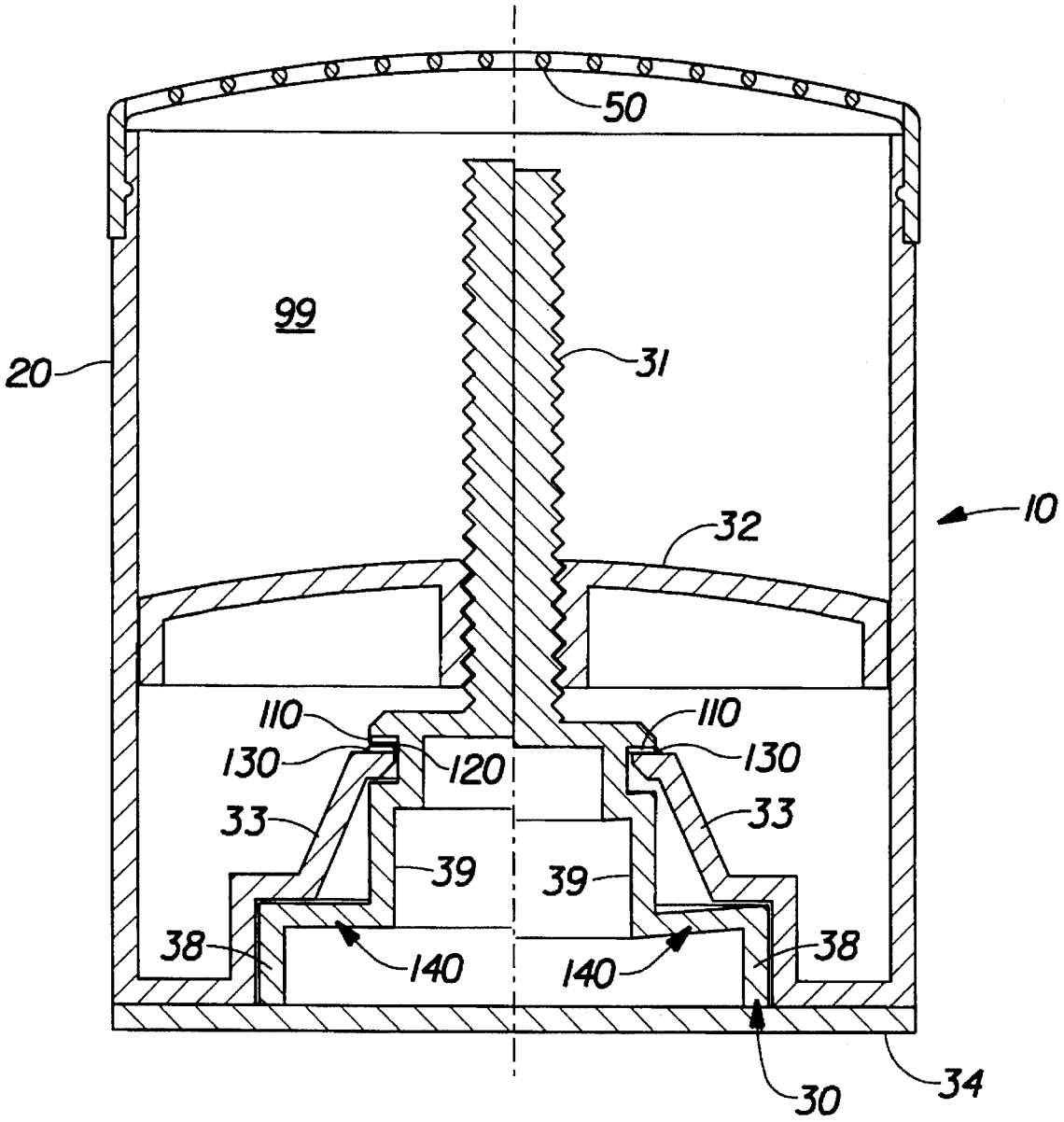
FIG. 10 is an elevational sectional view of the internal components of a presently preferred dispenser according to the present invention.

A presently preferred dispenser configuration is depicted in FIG. 10. As with the dispenser of FIG. 4, the preferred dispenser includes an elevator 32, an elevator screw 31, and a handwheel 30. Unlike the dispenser of FIG. 4, however, the spring action is provided by a spring 140 which is preferably unitarily molded into the handwheel 30 to allow the elevator screw 31 to move upward and downward with respect to the rim portion 38 of the handwheel. Also included as the force-limiting aspect of the advance mechanism is a series of interlocking ratchet teeth 110 and 130 on both a flange of the elevator screw (teeth 110) and a collar (teeth 130) of the top plate 33, which in FIG. 10 is shown to be preferably integrally molded with the container 20.

In FIG. 10, the left-hand side of the figure depicts the advance mechanism in a non-pre-loaded condition, i.e., not exerting force on the product 99. Teeth 110 and 130 are separated by a space 120. The right-hand side of the figure depicts the advance mechanism in the fully-pre-loaded condition, with the interlocking teeth 110 and 130 engaged, the spring 140 fully depressed, and the center portion 39 of the handwheel depressed relative to the rim portion 38. Bottom plate 34 prevents the handwheel from backing out of the dispenser when force is applied to the product. The dimensions of teeth 110 and 130, as well as the spring characteristics of spring 140, are tailored to achieve the desired force-limiting and force-maintaining characteristics with the product of interest.

Figure 11:
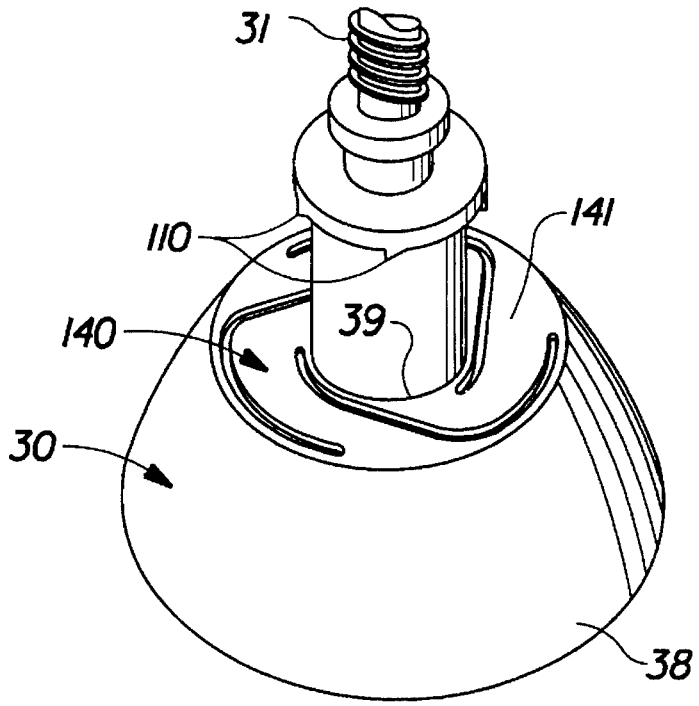
FIG. 11 is a perspective view of one handwheel configuration useful in the dispenser of FIG. 10.

FIG. 11 depicts one handwheel design which incorporates the integral spring 140 into the handwheel 30 itself. The integral spring 140 in this illustration is formed as a series of spring fingers 141 connecting the central portion 39 of the handwheel (at the point of attachment of the elevator screw 31) to the rim portion 38. These spring fingers as illustrated are formed by a series of slots extending entirely through the thickness of the handwheel in this annular region. These spring fingers flex and allow the central portion 39 to move axially relative to the rim portion 38, as depicted in FIG. 10.

Figure 12:
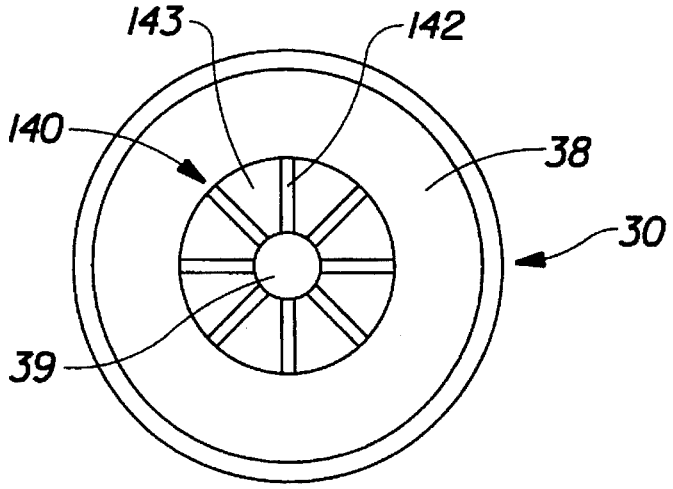
FIG. 12 is a bottom plan view of a presently preferred handwheel configuration useful in the dispenser of FIG. 10.

A presently preferred alternative to the spring fingers depicted in FIG. 11 is shown in FIG. 12, which is a view from below of a handwheel 30 which is substantially similar to that of FIG. 11 except for the design of spring 140. Preferably, the integral spring 140 takes the form of a diaphragm spring which is formed by molding a plurality of thickened radial spokes 142 into the annular region between central portion 39 and rim portion 38. The spokes 142 are separated by relatively thinner webs 143 such that the spring portion of the handwheel is continuous. The flexibility parameters of the integral spring may be controlled by the number, width, and thickness of the radial spokes and/or the webs between the spokes. The integral spring constructed according to this principle may be constructed from less expensive materials (such as polyolefins) than the spring finger design of FIG. 11 (which typically requires an engineering resin such as CELCON®, for example), and is more suited to fine-tuning of the flexibility characteristics. Since the integral spring is thus continuous material, this design also provides a more robust construction which may be less prone to breakage in service than the use of spring fingers. Other suitable integral spring designs may include the use of concentric rings or grooves molded or cut into the annular region between central portion 39 and rim portion 38.

Figure 13:
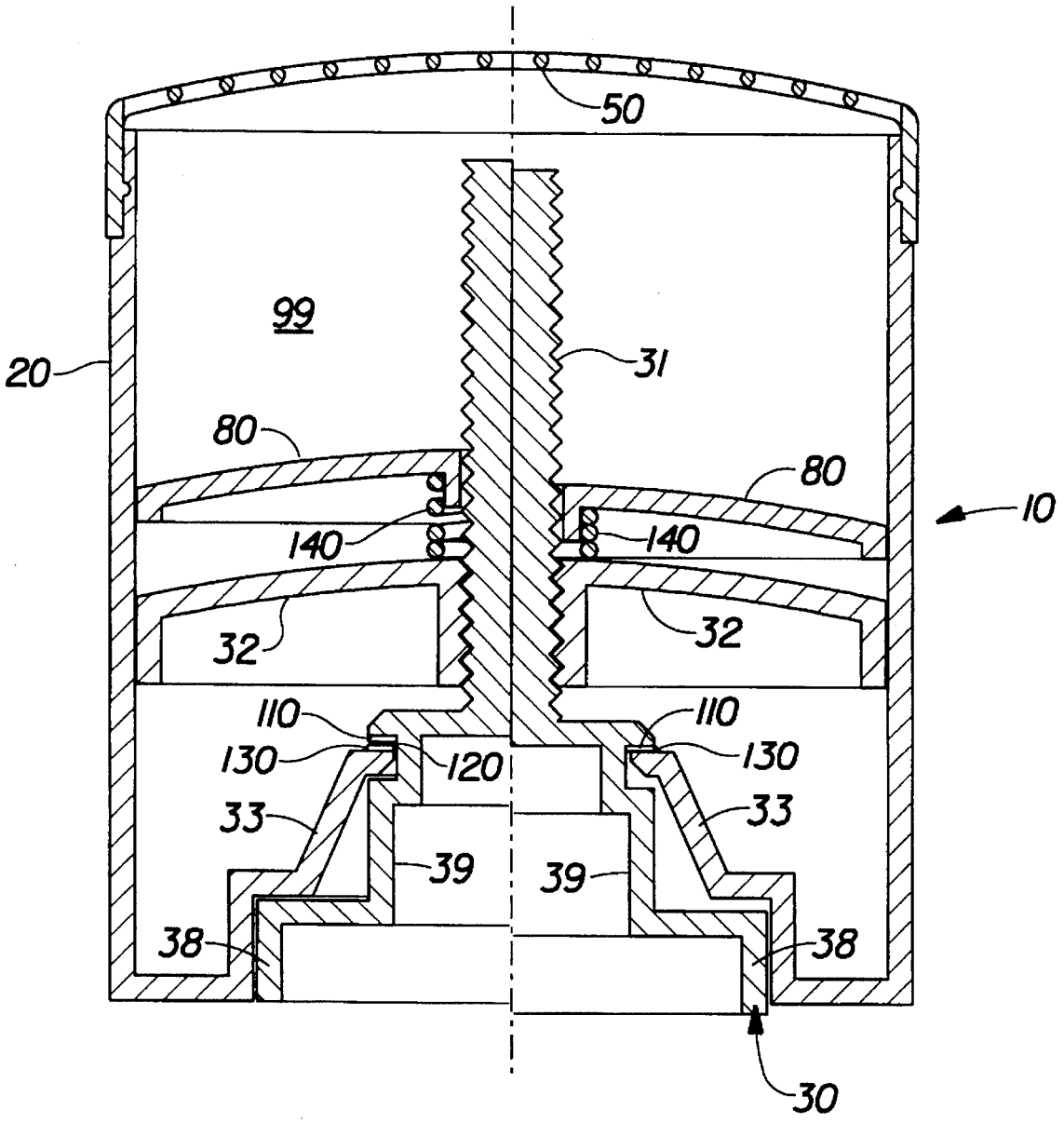
FIG. 13 is an elevational sectional view of the internal components of another dispenser according to the present invention.

FIG. 13 depicts an alternative dispenser execution which is substantially similar to the dispenser of FIG. 10, but relocates the spring element 140 from the handwheel to a location between the elevator 32 (which is now a driven elevator) and a biasing elevator 80 which is slideably disposed on elevator screw 31 and which contacts the lower edge of the product 99. In FIG. 13, the left-hand side of the figure depicts the advance mechanism in a non-pre-loaded condition, i.e., not exerting force on the product. The right-hand side of the figure depicts the advance mechanism in the fully-pre-loaded condition, with the interlocking teeth 110 and 130 engaged and the spring 140 fully compressed. Spring element 140 may be a conventional metallic coil-type spring, or any other suitable form of biasing element such as a leaf spring or compressible material. Handwheel 30 may thus be of conventional rigid design.

For any of the dispenser embodiments described herein, before use the handwheel is rotated until the force-limiting mechanism engages to prevent further rotation of the handwheel, and the mesh applicator head is then stroked across the desired surface. The surface of the product exposed via the interstitial spaces (apertures) in the mesh material is sheared off in conventional fashion and applied to the recipient surface. The mesh applicator head provides for a more even distribution of the product than conventional solid stick-type dispensers through the action of the solid portions of the mesh material as the applicator head is moved across the surface. During the dispensing cycle, the force-maintaining aspect of the elevator mechanism continues to advance product toward the mesh head under a pre-determined force level to maintain an optimal level of mesh/product contact pressure and maintain product presence in the interstitial spaces. After a pre-determined quantity of product is dispensed (a selected number of dispensing strokes, etc.), the force-limiting mechanism releases the handwheel to allow the consumer to advance additional product toward the mesh for the next dispensing operation.

The mesh applicator head may be removable from the container, thus promoting refillability of the package. In this fashion, the mesh applicator head may be removed from the dispensing opening of the dispenser to provide access to the interior of the dispenser via the open dispensing opening. Additional product may be placed into the dispenser and the mesh applicator head re-installed for continued use, or the mesh applicator head may be installed on a substitute twist-up dispenser.

The improved twist-up dispensers of the present invention may be utilized for applying a wide variety of products to a wide variety of surfaces. These products include anti-perspirants, deodorants, suntan lotions, depilatories, cosmetic products such as toners, bases, lipsticks, and rouges, soaps, detergents, pre-treaters, etc. in solid, gel, semi-solid, or other substantially solid forms. Surfaces include various parts of the human anatomy, including the skin in general and underams in particular, and fabric surfaces such as clothing and furniture. Of particular interest for use with the dispensers of the present invention are products of the anti-perspirant and deodorant variety.

An important characteristic of products which are suitable for use with dispensers according to the present invention is a physical characteristic which quantifies the degree to which the product exhibits solid-like behavior. This characteristic is commonly quantified in the art by a "penetration value", which is a number whose magnitude provides a means of comparing various materials.

Penetration values are a reflection of how far a needle will penetrate into a sample of the product under certain standard testing conditions. Higher numbers indicate greater penetration, and hence a "softer" product. The penetration values described herein were measured using ASTM test method D-5, using a Precision Model 73515 tester available from the Fischer Scientific Company. The penetration needle was according to ASTM Method D 1321-DIN 51 579, Officially certified, Taper-tipped needle, Number 18-0082, available from the Petrolab Corporation. Testing was done at 80 degrees Fahrenheit.

Products suitable for use in dispensers according to the present invention preferably have penetration values of between about 100 and about 250, more preferably between about 150 and about 200, and most preferably about 180.

To provide better overall distribution of product onto the receiving surface, the radius of curvature of the mesh applicator head may be tailored to provide a complementary matching curved surface for maximum contact area. For example, the preferred dispenser illustrated is suitable for use as a dispenser for anti-perspirant products, and accordingly has radii of curvature of 2.250 inches in the direction of the widest dimension and 0.955 inches in the direction of the least dimension. For other applications, such as lipstick, for example, the mesh applicator head may be more circular and have a lesser degree of curvature. Mesh applicator heads may even be essentially planar in nature.

The exposed surface area of the mesh applicator head, the extent to which the mesh material penetrates into the product surface, and the size and shape of the apertures in the mesh material may all be tailored to suit the natural curvature and/or resilience of the receiving surface and the characteristics of the product to provide optimized distribution of the product. A presently preferred approach is to first tailor the product to achieve the desired efficacy and distribution characteristics, then to tailor the parameters of the dispenser to achieve the desired application rates and ensure proper distribution of applied product.

The components of the improved dispensers of the present invention may be fabricated using any known methodology such as, for example, injection molding. The components may be formed of a wide variety of conventional materials, such as polyethylene, polypropylene, or other plastic materials, metal, etc. Suitable materials for each of the components include polyethylene, polypropylene, and/or co-polymers of polyethylene and polypropylene, although any of the polyolefins may be suitable for use in the present invention. Polypropylene is presently preferred for the mesh applicator head, elevator screw, container, and overcap, while polyethylene is presently preferred for use in the elevator. The presently preferred manufacturing process is injection molding.

Although the foregoing discussion and Drawing Figures have focused on a presently preferred advance mechanism of the twist-up variety, it is to be understood that the principles of the present invention may also be applied to other types of advance mechanisms, such as push-button-type ratcheting advance mechanisms, etc.

While particular embodiments of the present invention have been illustrated and described, it would be obvious to those skilled in the art that various changes and modifications can be made without departing from the spirit and scope of the present invention. For example, the product composition, the size and shape of the overall dispenser, the size and shape of the mesh applicator head, the dimensions, ratios, clearances, and tolerances of the dispenser components, and the materials utilized may all be tailored to suit particular applications. It is intended to cover in the appended Claims all such modifications that are within the scope of this invention.

EXAMPLE

The following Example illustrates a product and dispenser combination which has been successfully prepared and which illustrates the relationship between the various parameters discussed in detail above.

An anti-perspirant product suitable for use in dispensers according to the present invention was prepared from the following components (% by weight):

| | |
|---|---|
| Cyclomethicone | 56.51 |
| 50 cst Dimethicone | 3.05 |
| Silica | 0.18 |
| Stearyl Alcohol | 0.65 |
| Castor Wax | 1.94 |
| Polyethylene Beads | 0.18 |
| Behenyl Alcohol | 5.83 |
| Active Powder (ZAGS) | 20.30 |
| Dipropylene Glycol | 0.18 |
| Talc | 11.18 |
| | 100.00% |

The components were added in the order shown above. Batching is similar to that used to produce current commercially available anti-perspirant solids (heat to melt waxes, stir in powders, cool to just before solidification point, then pour into canisters).

The important feature of this formula is that the primary wax used is a long chain fatty alcohol which solidifies in small crystals. Thus, the total amount of waxes used can be lowered to allow the structure to be looser (to pass through the mesh dome).

This product formulation yielded a penetration value of 180 using the testing method described above.

An exemplary dispenser according to the embodiment of the present invention depicted in FIG. 10, for use with the product described above, was constructed having the following construction details:

| | |
|---|---|
| Mesh Spacing "S" | 0.075 inches |
| Shape of Interstitial Spaces | Circular |
| Mesh Radius "R" | 0.005 inches |
| Mesh Angle "A" | 70 degrees |
| Mesh Thickness "T" | 0.022 inches |
| Major Dimension | 2.138 inches |
| Minor Dimension | 1.332 inches |
| Radius of Curvature (Major Dimension) | 2.250 inches |
| Radius of Curvature (Minor Dimension) | 0.955 inches |
| Pre-load/threshold force | 4 inch-pounds |

This dispenser/product combination performed well and provided an even distribution of product on human skin with an absence of visible residue.

What is claimed is:

1. A dispensing package for dispensing a product onto a surface, said dispensing package comprising:

(a) a container body having an interior chamber for containing said product and a dispensing opening;

(b) a conformable applicator element affixed to said container body across said dispensing opening and substantially covering said dispensing opening, said applicator element having a plurality of discrete apertures extending therethrough, said apertures having upper edges which collectively define an applicator surface of said applicator element; and (c) a product supply mechanism within said interior chamber for advancing said product toward said applicator surface such that said product fills said apertures to a level substantially even with said applicator surface, said product supply mechanism including:

(i) a force-limiting element for halting advancement of said product, said force-limiting element having a pre-determined threshold which limits the amount of force said product can exert upon said applicator surface during advancement of said product to prevent extrusion of said product through said apertures; and (ii) a force-maintaining element for maintaining determined force level between said product and said applicator surface during dispensing of said product.

2. The dispensing package of claim 1, wherein said applicator element comprises a mesh material.

3. The dispensing package of claim 2, wherein said applicator element comprises a unitarily molded plastic mesh material.

4. The dispensing package of claim 1, wherein said apertures are uniformly spaced.

5. The dispensing package of claim 1, wherein said apertures have a uniform size.

6. The dispensing package of claim 1, wherein said apertures have a uniform cross-sectional shape.

7. The dispensing package of claim 1, wherein said force-maintaining element comprises a spring.

8. The dispensing package of claim 1, wherein said product supply mechanism comprises a twist-up advance mechanism.

9. The dispensing package of claim 8, wherein said advance mechanism includes an elevator, an elevator screw threadably engaging said elevator, and a rotatable handwheel for rotating said elevator screw.

10. The dispensing package of claim 9, wherein said force-maintaining element comprises a spring.

11. The dispensing package of claim 10, wherein said spring is unitarily formed with said handwheel.

12. The dispensing package of claim 11, wherein said spring comprises a series of radial spokes separated by thin webs.

13. The dispensing package of claim 1, wherein said force-limiting element comprises interlocking teeth.

14. The dispensing package of claim 1, wherein said pre-determined threshold is about 4 inch-pounds.

15. A dispensing package for dispensing a product onto a surface, said dispensing package comprising:

(a) a container body having an interior chamber for containing said product and a dispensing opening;

(b) a conformable applicator element affixed to said container body across said dispensing opening and substantially coveting said dispensing opening, said applicator element having a plurality of discrete apertures extending therethrough, said apertures having upper edges which collectively define an applicator surface of said applicator element; and (c) a twist-up product supply mechanism within said interior chamber for advancing said product toward said applicator surface such that said product fills said apertures to a level substantially even with said applicator surface, said product supply mechanism including an elevator, an elevator screw threadably engaging said elevator, and a rotatable handwheel for rotating said elevator screw, said product supply mechanism further including:

(i) a force-limiting element for halting advancement of said product, said force-limiting element having a pre-determined threshold which limits the amount of force said product can exert upon said applicator surface during advancement of said product to prevent extrusion of said product through said apertures, said force-limiting element including opposed pairs of interlocking ratchet teeth which are engageable to prevent rotation of said handwheel when said threshold is attained; and (ii) a force-maintaining element for maintaining a pre-determined force level between said product and said applicator surface during dispensing of said product, said force-maintaining element including a spring unitarily formed with said handwheel to bias said elevator toward said applicator element.

16. The dispensing package of claim 15, wherein said applicator element comprises a unitarily molded plastic mesh material.

17. A dispensing package for dispensing a product onto a surface, said dispensing package comprising:

(a) a container body having an interior chamber for containing said product and a dispensing opening;

(b) a conformable applicator element affixed to said container body across said dispensing opening and substantially covering said dispensing opening, said applicator element having a plurality of discrete apertures extending therethrough, said apertures having upper edges which collectively define an applicator surface of said applicator element; and (c) a twist-up product supply mechanism within said interior chamber for advancing said product toward said applicator surface such that said product fills said apertures to a level substantially even with said applicator surface, said product supply mechanism including a first elevator, an elevator screw threadably engaging said first elevator, a rotatable handwheel for rotating said elevator screw, and a second elevator slideably disposed on said elevator screw, said product supply mechanism further including:

(i) a force-limiting element for halting advancement of said product, said force-limiting element having a pre-determined threshold which limits the amount of force said product can exert upon said applicator surface during advancement of said product to prevent extrusion of said product through said apertures, said force-limiting element including opposed pairs of interlocking ratchet teeth which are engageable to prevent rotation of said handwheel when said threshold is attained; and (ii) a force-maintaining element for maintaining a pre-determined force level between said product and said applicator surface during dispensing of said product, said force-maintaining element including a spring located between said first elevator and said second elevator to bias said second elevator toward said applicator element.

18. The dispensing package of claim 17, wherein said applicator element comprises a unitarily molded plastic mesh material.

* * * * *

UNITED STATES PATENT AND TRADEMARK OFFICE

CERTIFICATE OF CORRECTION

PATENT NO. : 5,547,302

DATED : August 20, 1996

INVENTOR(S) : Arthur H. Dornbusch et al.

It is certified that error appears in the above-identified patent and that said Letters Patent is hereby corrected as shown below:

Column 10, lines 41-42, "deter-mined" should read -- a pre-determined --.

Column 11, line 14, "coveting" should read -- covering --.

Signed and Sealed this

Tenth Day of April, 2001

*Attest:*

Nicholas P. Godici

NICHOLAS P. GODICI

*Attesting Officer*

*Acting Director of the United States Patent and Trademark Office*